US005735302A

United States Patent [19]

Saliva

[11] Patent Number: 5,735,302

[45] Date of Patent: Apr. 7, 1998

[54] ADJUSTABLE HANGING SUNSHADE UMBRELLA

[75] Inventor: Fortunato Saliva, Novara, Italy

[73] Assignee: F.I.M. S.r.l., Italy

[21] Appl. No.: 738,020

[22] Filed: Oct. 25, 1996

[51] Int. Cl.[6] ..... A45B 11/00

[52] U.S. Cl. ..... 135/20.1; 135/21

[58] Field of Search ..... 135/20.1, 20.3, 135/21, 19, 98, 99, 90

[56] References Cited

U.S. PATENT DOCUMENTS

| | | | |
|---|---|---|---|
| 2,819,725 | 1/1958 | Deisenroth et al. | 135/20.3 |
| 3,765,434 | 10/1973 | Riggs | 135/20.1 |
| 4,449,542 | 5/1984 | McSwain et al. | 135/21 X |
| 4,586,525 | 5/1986 | Glatz et al. | 135/20.3 X |
| 4,674,523 | 6/1987 | Glatz | 135/21 |
| 5,002,081 | 3/1991 | Stromeyer | 135/21 |
| 5,116,258 | 5/1992 | Vennik | 135/20.3 |

FOREIGN PATENT DOCUMENTS

| | | | |
|---|---|---|---|
| 2266234 | 10/1993 | United Kingdom | 135/20.3 |

*Primary Examiner*—Lanna Mai

*Attorney, Agent, or Firm*—Laff, Whitesel, Conte & Saret, Ltd.

[57] ABSTRACT

An adjustable hanging sunshade umbrella is provided which comprises a side standard, a transverse arm joined to the side standard in cantilevered fashion, a central rod, support and operation means for a protective covering connected to the central rod, and a position-adjusting device adapted to cause rotation of the central rod relative to the axis of the transverse arm and lock it to the desired inclination of the protective covering.

8 Claims, 3 Drawing Sheets

ADJUSTABLE HANGING SUNSHADE UMBRELLA

BACKGROUND OF THE INVENTION

1. Field of the Invention

The present invention relates to an adjustable hanging sunshade umbrella of the type comprising a side standard and a transverse arm joined to the side standard in cantilevered fashion.

It is known that some types of hanging sunshade umbrellas comprise an asymmetric bearing structure made up of a side standard to be fastened to the ground and a transverse arm joined to the side standard in cantilevered fashion and generally having a rectilinear longitudinal-extension direction.

Connected to the free end portion of the transverse arm is a centre rod to which, in turn, support and operation means for a protective covering is connected. Said means usually comprises a ring to which radial support ribs are connected and a slider engaging radial operating rods active on the support ribs for closing and opening said protective covering.

2. Prior Art

In the known art hanging sunshade umbrellas briefly described above can be made adjustable by interposing an articulated joint, a ball-and-socket joint for example, between the central rod and the transverse arm. While this technical solution enables the protective covering to be inclined in all directions, it however has some limits and drawbacks.

In fact, first of all, it involves some complexity of operation, because when the two necessary functions for adjustment of the protective covering, that is displacement of the central rod and locking of same to the desired position, are to be carried out, the use of both hands of an individual or the presence of two individuals is needed, which is not very practical.

In addition, sometimes locking of the articulated joint between the central rod and transverse arm does not fully ensure a good stability and safety, above all in some occurrences such as arising of sudden gusts of wind because, as is known, articulated joints require very high frictional forces, which cannot be always obtained, in order to lock them.

Finally, according to the known art when adjustment of hanging sunshade umbrellas is to be done, a manual intervention at the central area of the protective covering is required, which area is generally of difficult access and operation because it is often occupied by people, tables, chairs and other objects for which the umbrella is intended and on which it performs its specific protective function.

SUMMARY OF THE INVENTION

Under this situation, the technical task underlying the present invention is to devise an adjustable hanging sunshade umbrella capable of substantially obviating the above-mentioned drawbacks.

Within the scope of this technical task, it is an important aim of the invention to device an adjustable hanging sunshade umbrella of easy and quick operation, which is steady at every position and settlement, and can be modified as to its setting without being it necessary to accede to the area underlying the protective covering.

The technical task mentioned and the aim specified are substantially achieved by an adjustable hanging sunshade umbrella comprising a position-adjusting device adapted to cause rotation of said central rod about a direction-adjusting axis substantially coincident with said longitudinal direction of the transverse arm until achievement of an angular position corresponding to a desired inclination of said protective covering and to lock said central rod to said desired angular position.

BRIEF DESCRIPTION OF THE DRAWINGS

The description of a preferred embodiment of an adjustable hanging sunshade umbrella in accordance with the invention is now given hereinafter by way of non-limiting example, with the aid of the accompanying drawings, in which.

DESCRIPTION OF THE PREFERRED EMBODIMENT

Figure 1:
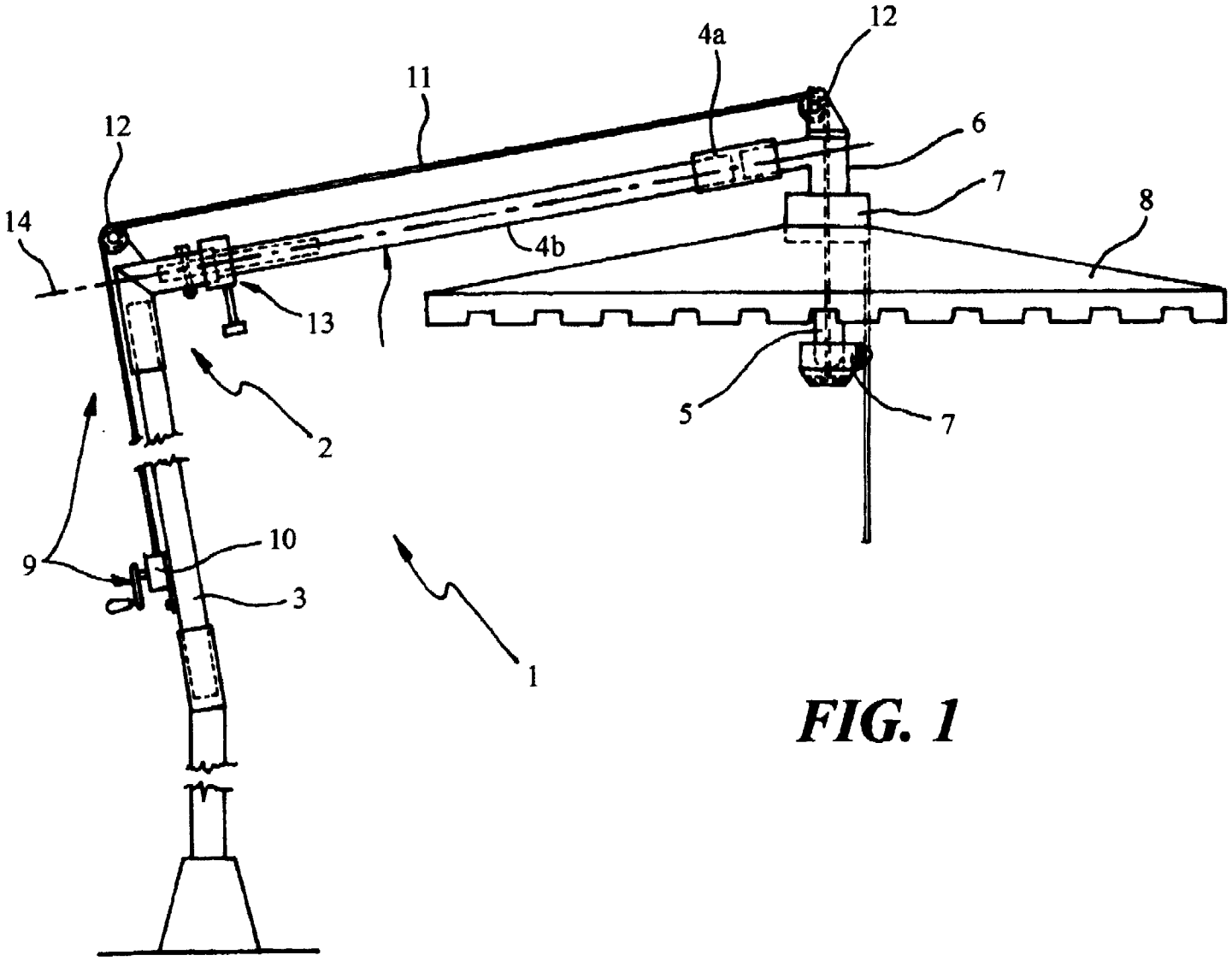
FIG. 1 is a side view of the inventive adjustable hanging sunshade umbrella.
Figure 2:
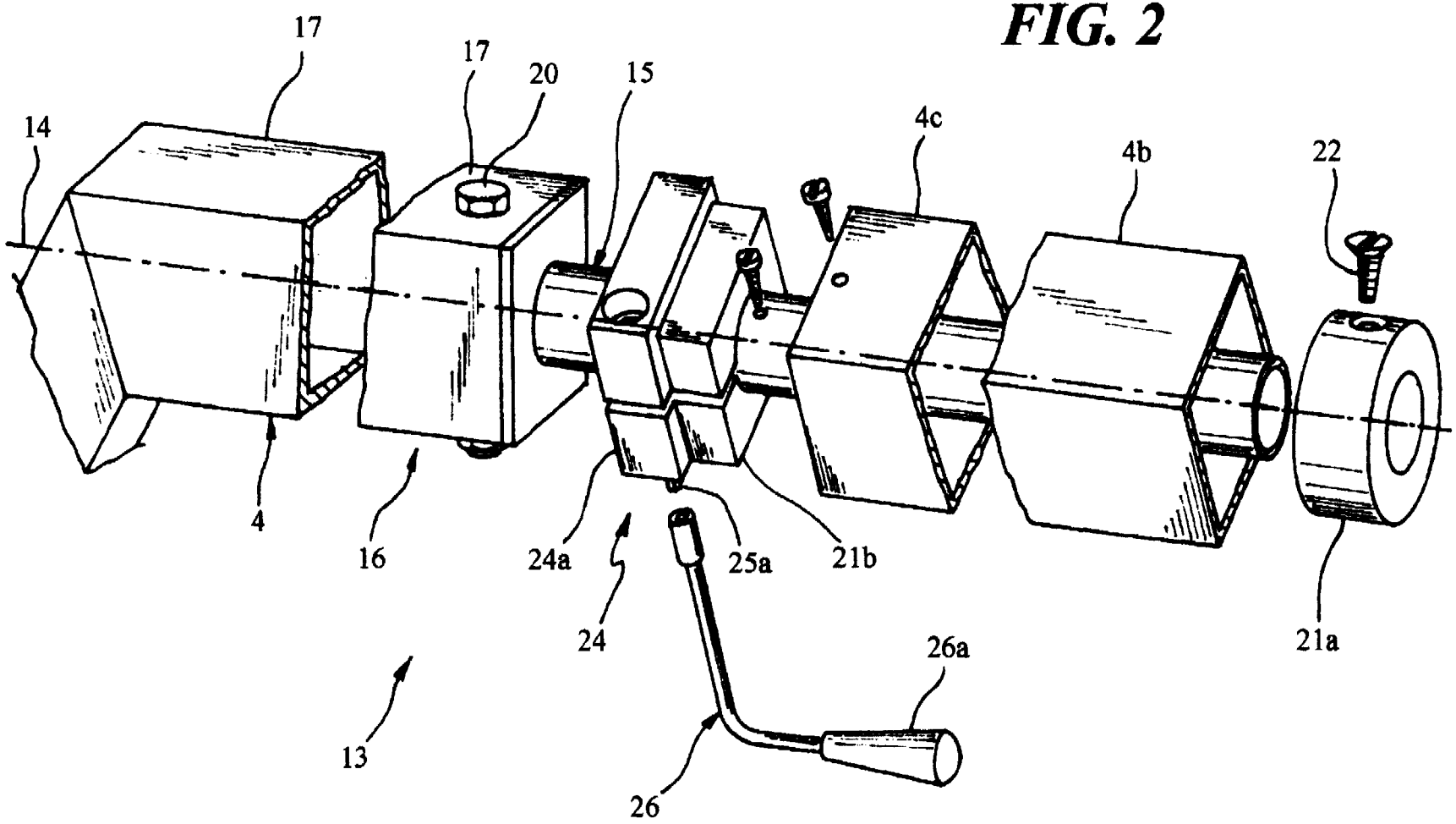
FIG. 2 is an exploded perspective view of a position-adjusting device included in the sunshade umbrella of FIG. 1.
Figure 3:
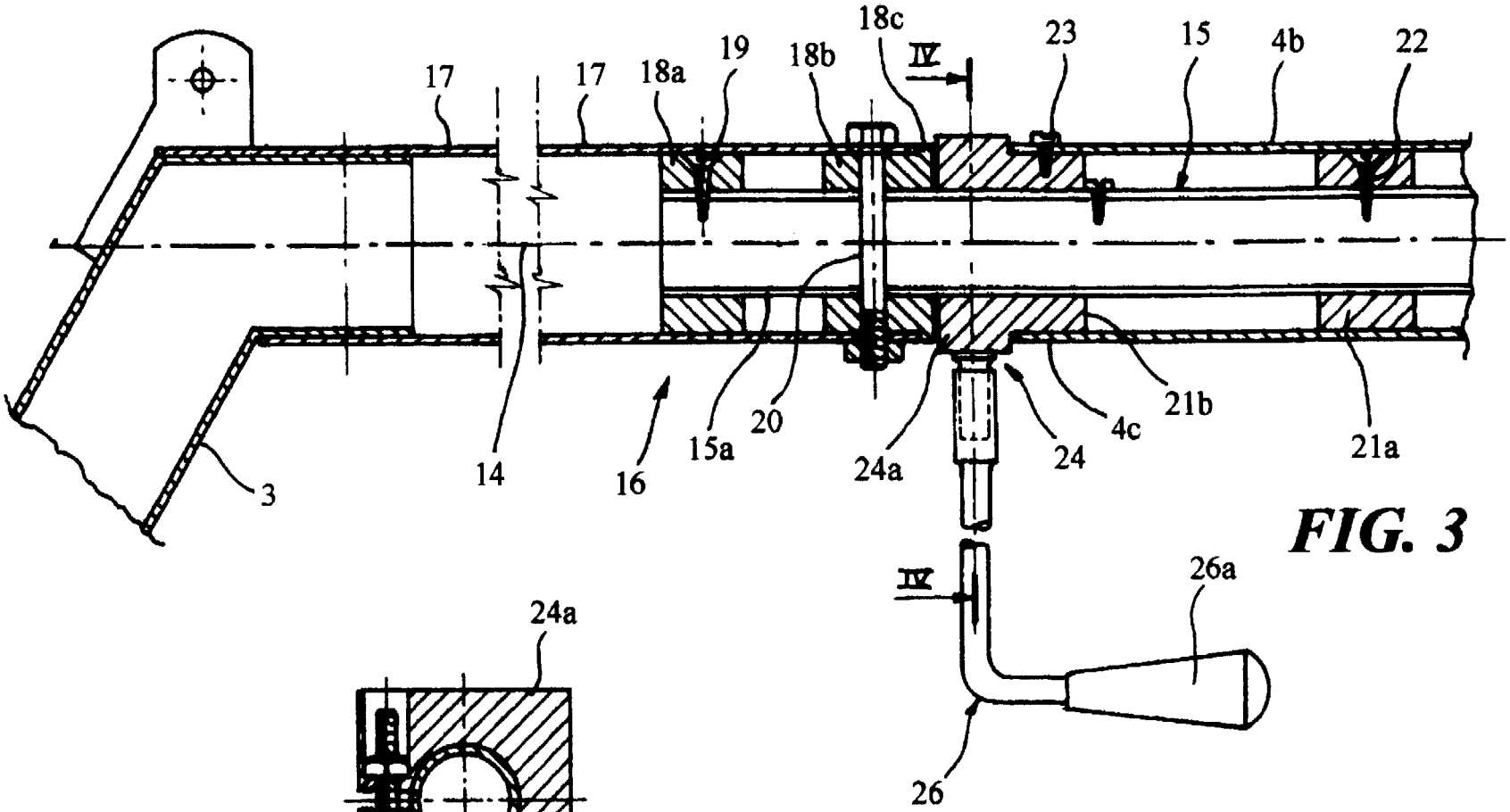
FIG. 3 highlights a longitudinal section of the device in FIG. 2.
Figure 4:
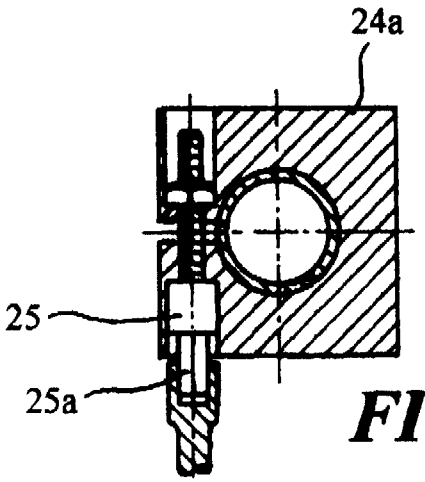
FIG. 4 is a sectional view taken along line IV—IV in FIG. 3.

With reference to the drawings, the adjustable hanging sunshade umbrella in accordance with the invention has been generally identified by reference numeral 1.

It comprises a bearing structure 2 formed of a side standard 3 and a transverse arm 4 joined to the standard 3 in cantilevered fashion and having a substantially rectilinear longitudinal-extension direction.

The transverse arm 4 comprises a first end portion 4*a* spaced apart from the side standard 3 and to which a central rod 5 is connected, upon interposition of an angled attachment element 6.

Connected to the central rod 5 is support and operation means 7 for a protective covering 8, which means is, in turn, operable by a driving apparatus 9 for opening and closing the protective covering. Said apparatus comprises a crank winder 10, a cable 11, and idle pulleys 12, all of a conventional type known per se.

In an original manner, the sunshade umbrella 1 comprises a position-adjusting device 13 adapted to cause the central rod 5 to rotate about a direction-adjusting axis 14 coincident with the longitudinal-extension direction of the transverse arm 4, so that said central rod 5 may be disposed at an angular position corresponding to the desired inclination of the protective covering 8. The position-adjusting device 13 is also capable of locking the central rod 5 to the desired angular position.

More particularly, the position-adjusting device 13 comprises a support and guide pin 15 defining the direction-adjusting axis 14 by its longitudinal axis and having an end portion 15*a* fixedly connected to the side standard 3 by fastening means 16 adapted to make the pin 15 itself integral with said standard thereby preventing any rotation thereof.

The fastening means 16 in turn comprises an attachment portion 17 of the transverse arm 4 integral with the side standard 3 and defined, like the whole transverse arm, by a tubular element of substantially square section. The end portion 15*a* of the pin 15 is fitted into the attachment portion 17 and is positioned in the middle of the latter by means of a pair of holed blocks for example comprising a first cylindrical block 18*a* and a second block 18*b* of square section, both conveniently sized.

A first screw 19 fixes the first block 18*a* to the pin 15 and a bolt passes through the attachment portion 17, the second block 18*a* and the pin 15, so that ultimately the pin 15 is made integral with the side standard 3.

Preferably, the second block 18*b* has an expansion 18*c* of the same shape as the outer contour of the attachment section 17, so that it behaves like a plug closing said attachment portion.

The support pin 15 emerges from the attachment portion 17 and practically defines an articulation-guiding shaft for a main portion 4*b* of the transverse arm 4 to which the first end portion 4*a* is connected. The main portion 4*b* is therefore in alignment with the attachment portion 17 and advantageously has a transverse section of a substantially square tubular configuration, like said attachment portion 17.

Interposed between the main portion 4*b* and the pin 4 is coupling means 21*a* and 21*b* adapted to define rotatory coupling elements between said main portion 4*b* and pin 15. The rotatory coupling elements 21*a* and 21*b* are for example comprised of a first sleeve 21*a* of cylindrical conformation, sliding within the main portion 4*b*, fixed to the pin 15 by means of a second screw 22, and a second sleeve 21*b* of an external square contour sliding on the pin 15 and fixed to the main portion 4*b* by a third screw 23 as well as by its own outer surface preventing any rotation with respect to the main portion of the transverse arm 4.

The above-mentioned main portion can be fixedly hold against rotation in respect of the pin 15, and therefore the direction-adjusting axis 14, by a locking element 24 comprising a clamping portion 24*a*. Integral with said clamping portion is a connection portion the shape of which matches the shape of a square-section cavity of a second end portion 4*c* of the end arm 4, opposed to the first end portion 4*a*. Said connection portion of the locking element 24 is advantageously defined by the above-mentioned second sleeve 21*b* embodying a rotatory coupling element together with the pin 15, and is therefore fitted into the cavity formed in the second end portion 4*c*. The clamping portion 24*a* has a transverse section of greater area than the connection portion 21*b* so that it can abut against the second end portion 4*c* in side by side relationship therewith and be therefore located externally of the cavity of said portion 4*c* in contact with the expansion 18*c* of the block 18*b* fitted in the attachment portion 17. Finally, a driving screw 25 is provided which is capable of moving the two jaws of the clamping portion 24*a* close to and away from each other.

The driving screw 25 has a head 25*a* projecting from the clamping portion 24*a* and suitable for coupling with a driving wrench 26 provided with a handgrip 26*a* adapted to cause rotation both of the driving screw 25 along its own axis and the locking element 24 about the pin 15.

Operation of the position-adjusting device for a hanging sunshine umbrella described above mainly as regards structure is as follows.

By acting on the handgrip 26*a* of the driving wrench 26, closure of the clamping portion 24*a* is first loosened until said portion is disengaged from pin 15 to a sufficient extent so as to enable rotation of the locking element about the axis of the pin 15 itself. Once the loosening step is over, rotation of the locking element 24 is caused, still acting on the handgrip 26*a*, and therefore of the transverse arm 4 and central rod too, which are connected to said locking element, until the desired inclination of the protective covering 8 is achieved.

Subsequently, by turning the driving wrench 26, the jaws of the clamping portion 24*a* are closed and consequently the locking element 24, transverse arm 4 and central rod 5 are fixedly stopped to the desired angular position.

The invention achieves important advantages.

First of all, the hanging sunshade umbrella in accordance with the invention enables a quick and very easy adjustment of its position because the use of one hand alone is sufficient for performing both the operation involving rotation of the protective covering and the operation for locking and unlocking the transverse arm to the desired angular position.

In addition, the position-adjusting operation is carried out by an operator located close to the side standard, without his being obliged to accede to the area underlying the protective covering.

Finally, the position-adjusting device in accordance with the invention enables the protective covering to be locked in a steady and safe manner to the desired inclination because the clamping closure of the locking element of a cylindrical conformation provided therein allows a high frictional force to be exerted on the support pin, of an amount capable of holding the transverse arm of the sunshine umbrella against accidental rotations.

It will be moreover recognized that the particular embodiment shown is also advantageous in its most specific aspects. Many modifications and variations can be made to the invention, all of them falling within the scope of the inventive idea. In addition, all of the details may be replaced by technically equivalent elements. In carrying out the invention practically, the materials, shapes and sizes can be of any nature and magnitude, in accordance with requirements.

What is claimed is:

1. An adjustable hanging sunshade umbrella comprising:

a support structure provided with a side standard and a transverse arm joined to the side standard in cantilevered fashion and having a substantially rectilinear longitudinal-extension direction, a central rod connected to a first end portion of said transverse arm, support and operation means for a protective covering connected to said central rod, and a position-adjusting device rotating said central rod about a direction-adjusting axis substantially coincident with said longitudinal-extension direction of the transverse arm and locking said central rod at a desired angular position.

2. The sunshade umbrella as claimed in claim 1, wherein said position-adjusting device comprises:

a support and guide pin defining said direction-adjusting axis and having an end portion connected to said side standard, coupling means between said support and guide pin and at least one main portion of said transverse arm to which said first end portion is connected, and at least one locking element holding said main portion of the transverse arm against rotation with respect to said direction-adjusting axis.

3. The sunshade umbrella as claimed in claim 2, wherein fastening means is provided for securing the end portion of said support and guide pin to said side standard, which means is adapted to make said pin integral with the side standard itself and to prevent rotation of the pin in respect of the side standard, and wherein said coupling means is defined by rotatory coupling elements and said locking element prevents rotation of said main portion of the transverse arm in respect of said pin.

4. The sunshade umbrella as claimed in claim 3, wherein said main portion of the transverse arm is defined by a tubular element of substantially square section and wherein said elements for the rotatory coupling with said pin comprise at least two sleeves interposed between said pin and tubular elements, said locking element comprising a portion for connection with said main portion of the transverse arm and a portion for clamping said pin.

5. The sunshade umbrella as claimed in claim 4, wherein said connection portion of said locking element has a shape matching the shape of the square-section cavity of a second end portion of the transverse arm opposed to said first end portion, said connection portion being fitted in said cavity and said clamping portion being located externally of said cavity in side by side relationship with said second end portion.

6. The sunshade umbrella as claimed in claim 5, wherein one of said sleeves interposed between said pin and tubular element is defined by said connection portion of said locking element.

7. The sunshade umbrella as claimed in claim 5, wherein a driving screw operates said clamping portion and a driving wrench is coupled with said driving screw and is provided with a handgrip adapted to cause rotation both of the screw itself along its own axis and of said locking element about said pin.

8. The sunshade umbrella as claimed in claim 5, wherein said fastening means for said end portion of said pin comprises an attachment portion for joining said transverse arm to said side standard in alignment with said main portion, said pin having said end portion fitted in said attachment portion and said clamping portion of the locking element being disposed between said attachment portion and main portion of the transverse arm.

* * * * *